US011511174B1

(12) United States Patent
Powell

(10) Patent No.: US 11,511,174 B1
(45) Date of Patent: Nov. 29, 2022

(54) THROWING APPARATUS AND METHOD

(71) Applicant: Richard Powell, Austin, TX (US)

(72) Inventor: Richard Powell, Austin, TX (US)

( * ) Notice: Subject to any disclaimer, the term of this patent is extended or adjusted under 35 U.S.C. 154(b) by 0 days.

(21) Appl. No.: 17/717,492

(22) Filed: Apr. 11, 2022

(51) Int. Cl.
*A63B 69/40* (2006.01)

(52) U.S. Cl.
CPC ..... *A63B 69/408* (2013.01)

(58) Field of Classification Search
CPC ..... A63B 69/407; A63B 69/408; F41B 3/03
USPC ..... 124/6, 7
See application file for complete search history.

(56) References Cited

U.S. PATENT DOCUMENTS 3,406,674 A * 10/1968 Zone ..... A63B 69/408 124/36
3,552,371 A * 1/1971 Kahelin ..... A63B 69/408 124/36
3,722,494 A * 3/1973 Slevin ..... A63B 69/408 124/47
4,844,045 A * 7/1989 Powell ..... A63B 69/408 124/80
4,860,717 A * 8/1989 Powell ..... A63B 69/408 124/36
5,439,212 A * 8/1995 Hart ..... A63B 69/408 124/7
5,660,386 A * 8/1997 Krieger ..... A63B 69/407 124/7
6,129,076 A * 10/2000 Powell ..... A63B 69/408 124/36
7,415,976 B1 * 8/2008 Powell ..... F41B 3/04 124/16
8,286,619 B2 * 10/2012 Mihaljevic ..... A63B 69/408 124/16
10,603,568 B2 * 3/2020 Palanethra ..... F41B 3/03
11,077,353 B1 * 8/2021 Kamstra ..... F41B 3/03
2002/0179073 A1 * 12/2002 Erickson ..... A63B 69/407 124/16
2010/0307470 A1 12/2010 Mihaljevic
2013/0333679 A1 * 12/2013 Kroll ..... A63B 69/40 124/7
2019/0290989 A1 9/2019 Palanethra

* cited by examiner

*Primary Examiner* — Alexander R Niconovich
(74) *Attorney, Agent, or Firm* — J. Nevin Shaffer, Jr.

(57) ABSTRACT

A throwing apparatus and method a throwing apparatus has a main body connected to a base. A cocking arm is connected with the main body at a main body axle and movably connected with a release arm. A throwing assembly is connected to a throwing assembly bracket connected to the main body at the main body axle, where the throwing assembly includes an adjustable angle assembly movably connectable with the throwing assembly, the throwing assembly configured to support a projectile, where the projectile is held at selected angles in relation to the throwing assembly by the adjustable angle assembly and where the release arm is configured to releasably connect with the throwing assembly. A power assembly is provided with a first end and a second end, where the first end is connected with the throwing assembly bracket and the second end is connected with the main body.

20 Claims, 14 Drawing Sheets

THROWING APPARATUS AND METHOD

FIELD OF THE INVENTION

This invention relates to a throwing apparatus. In particular, in accordance with one embodiment, the invention relates to a throwing apparatus having a main body connected to a base. A cocking arm is connected with the main body at a main body axle and movably connected with a release arm. A throwing assembly is connected to a throwing assembly bracket connected to the main body at the main body axle, where the throwing assembly includes an adjustable angle assembly movably connectable with the throwing assembly, the throwing assembly configured to support a projectile, where the projectile is held at selected angles in relation to the throwing assembly by the adjustable angle assembly and where the release arm is configured to releasably connect with the throwing assembly. A power assembly is provided with a first end and a second end, where the first end is connected with the throwing assembly bracket and the second end is connected with the main body.

BACKGROUND OF THE INVENTION

The present invention relates to a mechanically operated projectile throwing device. More specifically, this invention pertains to a mechanically operated ball throwing device also known as a pitching machine in layman's terms. Pitching machines are used by a variety of user groups including players, coaches, parents, schools, universities, sports organizations, professional athletes, as well as sports enthusiasts.

The available pitching machines on the market typically use electricity as a power source, although there are mechanically operated devices as well. Of the existing mechanically operated machines on the market, most are bulky, utilize a single spring system that needs to be replaced very frequently, uses foot power to operate, forces the user to stand on one side of the machine regardless of the dominant side of the user, must have parts removed to change the type of ball being thrown, and are difficult to secure to the ground without the use of external weight such as sandbags. Some machines have an upright that is welded and bolted to the base. This has caused problems with wear resulting in breaking at the point of stress.

No matter the prior art design, adjusting them for the purpose of throwing one type of projectile, a baseball for example only and not by limitation, and then changing to a different ball, such as a softball, is a tedious, complex process often with limited success.

Further, prior art machines are not capable of throwing a projectile very slowly much less rapidly changing from slow to fast.

Still further, prior art devices are not easily adjustable from slow to fast to faster speeds without time consuming mechanical adjustments.

Further still, prior are devices have no ability to adjust the starting position of the device from an upright position to a forward leaning or backward leaning starting position.

Thus, there is a need in the art for an improved throwing apparatus and method that is compact and portable in design, easy to assemble and operate and is adjustable in multiple manners such that any type of projectile may be thrown at any desired speed and direction.

It therefore is an object of this invention, among other things, to provide an improved throwing apparatus and method that is compact in design, easy to assemble and operate and is adjustable in multiple manners such that any type of projectile may be thrown at any desired speed and direction.

SUMMARY OF THE INVENTION

Accordingly, the improved throwing apparatus and method of the present invention, according to one embodiment, includes a main body connected to a base. A cocking arm is connected with the main body at a main body axle and movably connected with a release arm. A throwing assembly is connected to a throwing assembly bracket connected to the main body at the main body axle, where the throwing assembly includes an adjustable angle assembly movably connectable with the throwing assembly, the throwing assembly configured to support a projectile, where the projectile is held at selected angles in relation to the throwing assembly by the adjustable angle assembly and where the release arm is configured to releasably connect with the throwing assembly. A power assembly is provided with a first end and a second end, where the first end is connected with the throwing assembly bracket and the second end is connected with the main body.

All terms used herein are given their common meaning so that "movably connectable" identifies and describes a connection made between the two connected elements that are allowed to move with relation to each other, such as a hinge or pivot connection for example only and not by limitation. Likewise, "releasably connect" describes a structure where one device is connected with another but is designed to release the connection according to the operation of one with the other.

In another aspect, the adjustable angle assembly includes a pair of side guides such that the projectile is supported by the throwing assembly and by the pair of side guides and where the side guides are curved, non-straight edges.

According to another embodiment, a throwing apparatus includes a main body connected to a base and a cocking arm connected with the main body at a main body axle and movably connected with a release arm. A throwing assembly is connected to a throwing assembly bracket connected to the main body at the main body axle, the throwing assembly configured to support a projectile where the release arm is configured to releasably connect with the throwing assembly. A power assembly has a first end and a second end, where the first end is connected with the throwing assembly bracket, the power assembly configured to releasably connect with a velocity bracket where the velocity bracket is movably connected with the main body and includes more than one power assembly notch configured to receive the second end of the power assembly.

In one aspect of this embodiment, the velocity bracket includes a first power assembly notch configured to hold the second end of the power assembly against movement and a second power assembly notch where the second power assembly notch is longer than the first power assembly notch such that the second end of the power assembly is free to move within and along the longer second power assembly notch.

According to another embodiment, a throwing apparatus consists of a main body connected to a base. A cocking arm is connected with the main body at a main body axle and is movably connected with a release arm. A throwing assembly is connected to a throwing assembly bracket connected to the main body at the main body axle, the throwing assembly configured to support a projectile where the release arm is configured to releasably connect with the throwing assembly. A power assembly has a first end and a second end, where the first end is connected with the throwing assembly bracket and a speed control arm is connected with the second end of the power assembly, the speed control arm including a speed control bracket with more than one speed control slot where the more than one speed control slot is selectively connectable with the main body.

In one aspect of this embodiment, there are seven speed control bracket slots.

According to another embodiment, a throwing apparatus comprises a main body connected to a base. A cocking arm is connected with the main body at a main body axle and movably connected with a release arm. A throwing assembly is connected to a throwing assembly bracket connected to the main body at the main body axle, the throwing assembly configured to support a projectile where the release arm is configured to releasably connect with the throwing assembly. A power assembly is provided with a first end and a second end, where the first end is connected with the throwing assembly bracket and the second end is connected with the main body. A base angle bracket is connected with the base and adjustably connectable with the main body at more than one location along the main body and where the main body is connected with the base with a hinge bracket such that the angle of the main body in relation to the base is adjustable at the more than one location with the base angle bracket.

In one aspect of this embodiment, the base angle bracket includes one connection hole and the main body includes a series of connection holes such that the angle of the main body in relation to the base is selectively adjustable by alignment of the base angle bracket connection hole with one of the series of main body connection holes.

According to another embodiment, a throwing apparatus includes a main body connected to a base and a cocking arm connected with the main body at a main body axle and movably connected with a release arm. A throwing assembly is connected to a throwing assembly bracket connected to the main body at the main body axle, where the throwing assembly includes an adjustable angle assembly movably connectable with the throwing assembly, the throwing assembly configured to support a projectile, where the projectile is held at selected angles in relation to the throwing assembly by the adjustable angle assembly and where the release arm is configured to releasably connect with the throwing assembly. A power assembly has a first end and a second end, where the first end is connected with the throwing assembly bracket, the power assembly configured to releasably connect with a velocity bracket where the velocity bracket is movably connected with the main body and includes more than one power assembly notch configured to receive the second end of the power assembly. A speed control arm is connected with the velocity bracket the speed control arm including a speed control bracket with more than one speed control slot where the more than one speed control slot is selectively connectable with the main body. A base angle bracket is connected with the base and adjustably connectable with the main body at more than one location along the main body and where the main body is connected with the base with a hinge bracket such that the angle of the main body in relation to the base is adjustable.

In one aspect of this embodiment, the apparatus further includes a micro-adjuster knob connected with the main body configured to adjustably contact the cocking arm in a cocked position.

In another aspect, the power assembly is a spring and in a further aspect, the power assembly is a pair of springs.

In one aspect, the adjustable angle assembly includes a series of non-linear connection holes and the throwing assembly includes a series of linear connection holes such that connection of one of the adjustable angle assembly series of non-linear connection holes with one of the throwing assembly series of linear connection holes creates a selected angle.

In another aspect, the projectile is selected from a group consisting of:

baseballs, softballs, soccer balls, tennis balls and volleyballs.

In one aspect, a front support leg is connected to the base extending to both sides of the base and in one aspect, the front support leg includes a first leg and a second leg where the first leg and the second leg are pivotally connected to the base.

According to another embodiment, a projectile throwing method consists of:

a. providing a main body connected to a base; a cocking arm connected with the main body at a main body axle and movably connected with a release arm; throwing assembly connected to a throwing assembly bracket connected to the main body at the main body axle, where the throwing assembly includes an adjustable angle assembly movably connectable with the throwing assembly, the throwing assembly configured to support a projectile, where the projectile is held at selected angles in relation to the throwing assembly by the adjustable angle assembly and where the release arm is configured to releasably connect with the throwing assembly; a power assembly with a first end and a second end, where the first end is connected with the throwing assembly bracket, the power assembly configured to releasably connect with a velocity bracket where the velocity bracket is movably connected with the main body and includes more than one power assembly notch configured to receive the second end of the power assembly; a speed control arm connected with the velocity bracket the speed control arm including a speed control bracket with more than one speed control slot where the more than one speed control slot is selectively connectable with the main body: a base angle bracket connected with the base and adjustably connectable with the main body at more than one location along the main body and wherein the main body is connected with the base with a hinge bracket such that the angle of the main body in relation to the base is adjustable; and b. moving the cocking arm to connect the release arm with the throwing assembly and moving the cocking arm to a cocked position.

In one aspect, a micro-adjuster knob is connected with the main body and is configured to adjustably contact the cocking arm in the cocked position.

In another aspect, the power assembly is a spring.

In a further aspect, the projectile is selected from a group consisting of:

baseballs, softballs, soccer balls, tennis balls and volleyballs.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
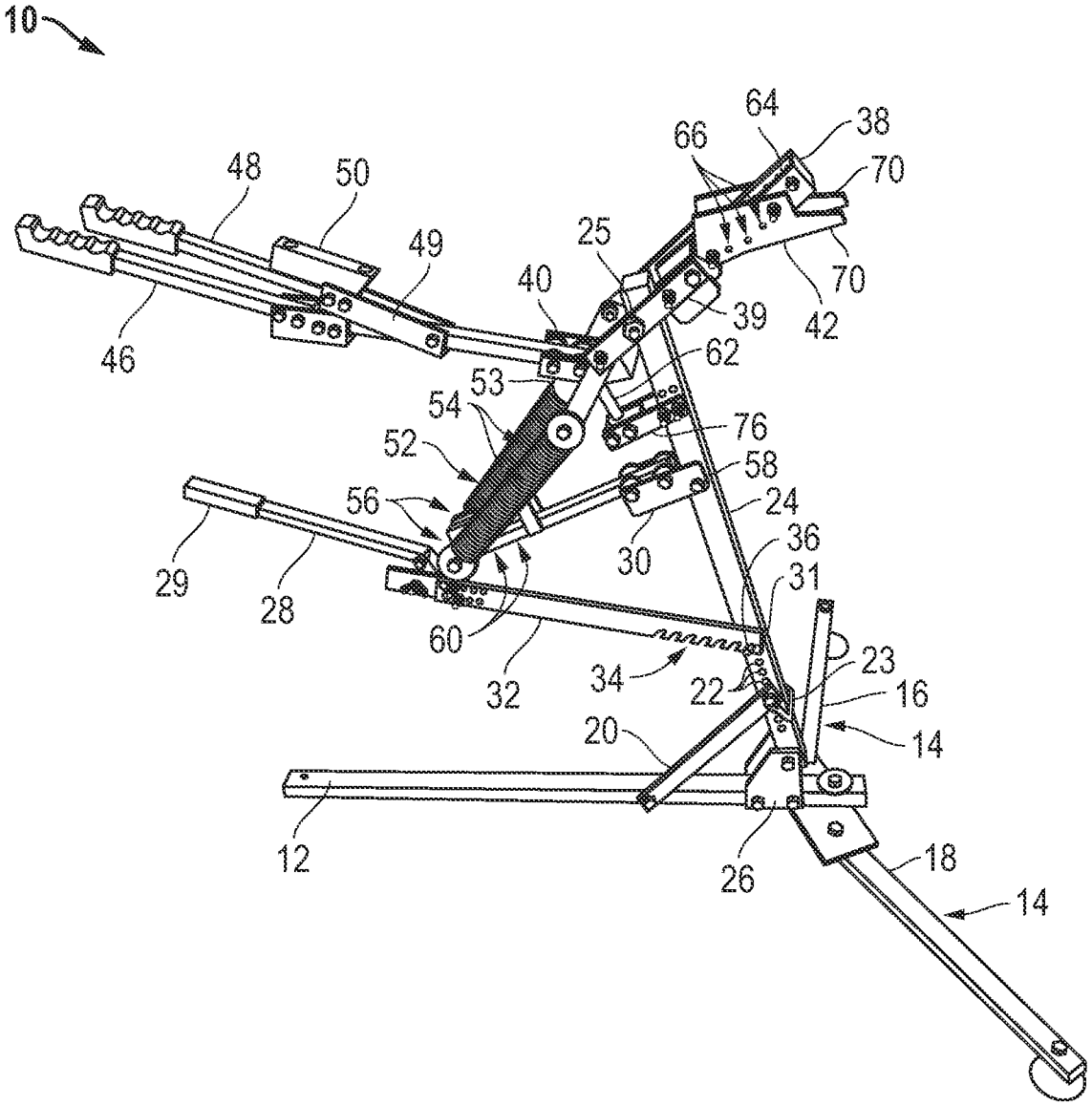
FIG. 1 is a perspective view of the throwing apparatus of the present invention in the starting, uncocked position.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described method may be altered so that certain steps are conducted in parallel or independent, with other steps, to the extent that the steps are not dependent upon each other. Thus, the specific order of steps described herein is not to be considered as implying a specific sequence of steps to perform the process. In alternative embodiments, one or more process steps may be implemented by a user assisted process and/or manually. Other alterations or modifications of the above methods are also contemplated.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

A preferred embodiment of the present invention is illustrated by way of example in FIGS. 1-14. With specific reference to FIG. 1, according to one embodiment, throwing apparatus 10 includes a base 12 with a front support leg 14 connected to the base 12 extending to both sides of the base 12 as shown. In one aspect, the front support leg 14 includes a first leg 16 and a second leg 18 where the first leg 16 and the second leg 18 are pivotally connected to the base 12.

Base angle bracket 20 is connected with the base 12 and adjustably connectable with the main body 24 at more than one location 22 (pin holes) by means of location retaining pin 23 along the main body 24 and where the main body 24 is connected with the base 12 with a hinge bracket 26. As a result, the angle of the main body 24 in relation to the base 12 is adjustable from a rearward leaning position as shown in FIG. 1, to a position where the main body 24 is perpendicular to the base 12 (See FIG. 10), to a position where the main body 24 is held in a forward tilting position toward front support legs 14 (See FIG. 11) and to other in between positions as the user deems most suitable to the conditions.

Speed control arm 28 is connected with a velocity bracket 30. The speed control arm 28 has a speed control arm handle 29 preferably and includes a speed control bracket 32 with more than one speed control slot 34 where the more than one speed control slot 34 is selectively connectable with the main body 24 by means of a bolt 36, for example only and not by limitation. Preferably, as shown, there are seven speed control slots 34. Whichever speed control slot 34 is chosen, the speed control bracket 32 is held in position by means of a speed control arm retainer 31 such as a wing nut connected with bolt 36 for example only and not by limitation.

Still referring to FIG. 1, throwing assembly 38 is connected to a throwing assembly bracket 39 which is connected with a main body axle 25 to main body 24. Cocking arm bracket 40 is also separately connected to main body axle 25 which in turn is connected to the main body 24. Throwing assembly 38 includes an adjustable angle assembly 42 (as will be described more fully hereafter with reference to FIG. 5) movably connectable with the throwing assembly 38. The throwing assembly 38 is configured to support a projectile 44 (See FIG. 4), such that the projectile 44 is held at selected angles in relation to the throwing assembly 38 by the adjustable angle assembly 42.

A cocking arm 46 is connected with the cocking arm bracket 40 and main body axle 25 and, thus, with the main body 24 and movably connected with a release arm 48. The release arm 48 is configured to releasably connect with the throwing assembly 38 by means of release block 50 in cooperation with cross bar 64 attached to throwing assembly 38.

Power assembly 52 has a first end 54 and a second end 56, where the first end 54 is connected with the power assembly bracket 53. The power assembly bracket 53 is connected to the throwing assembly bracket 39. The second end 56 of the power assembly 52 is configured to releasably connect with velocity bracket 30. Velocity bracket 30 is movably connected with the main body 24 at pivot point 58 and includes more than one power assembly notch 60 (more clearly shown in FIG. 6) configured to receive the second end 56 of the power assembly 52.

Figure 4:
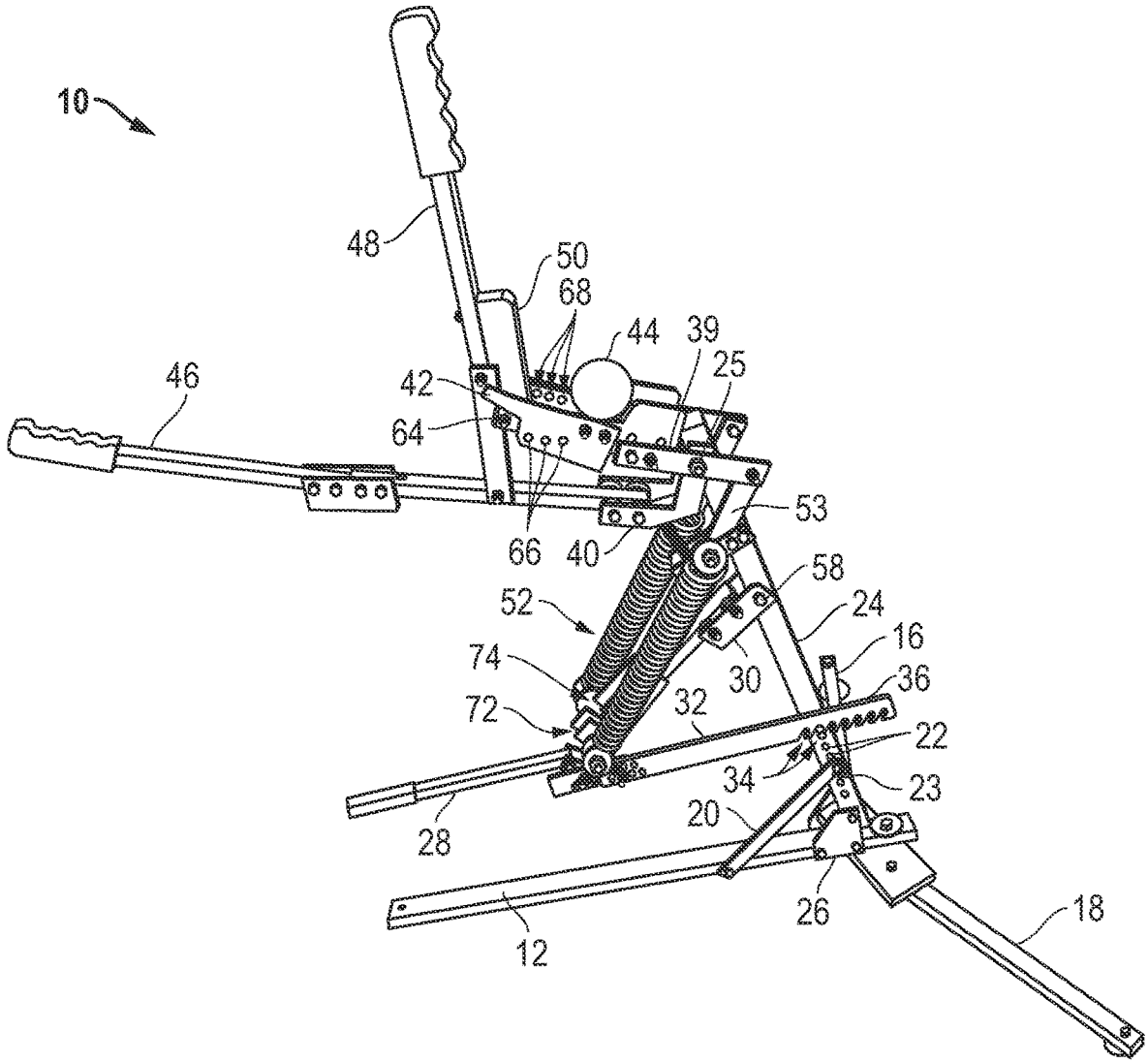
FIG. 4 is a perspective view of the invention of FIG. 1 showing the invention in the cocked position with a projectile in place on the throwing assembly.
Figure 7:
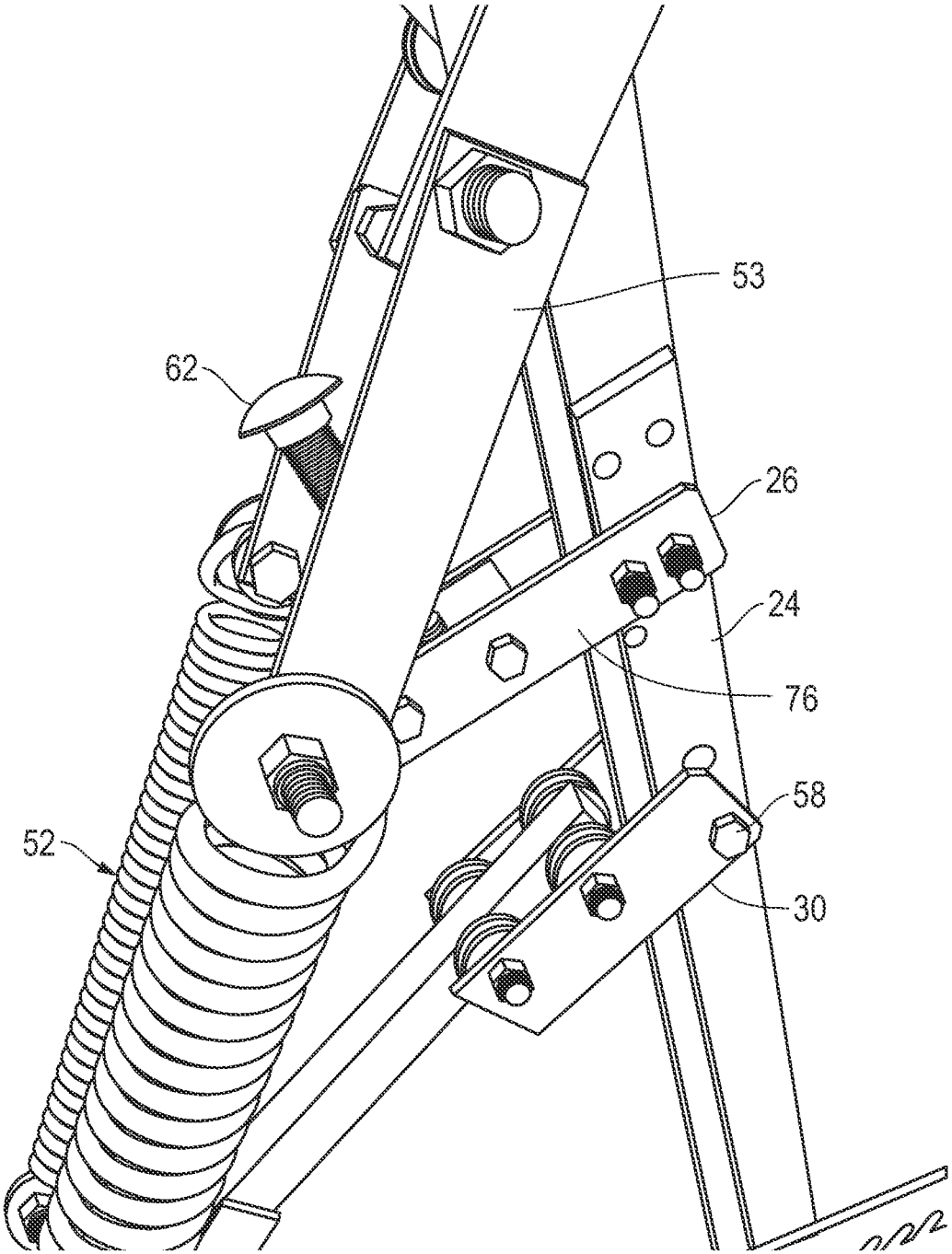
FIG. 7 is a close up of the micro-adjuster of the invention of FIG. 1.
Figure 8:
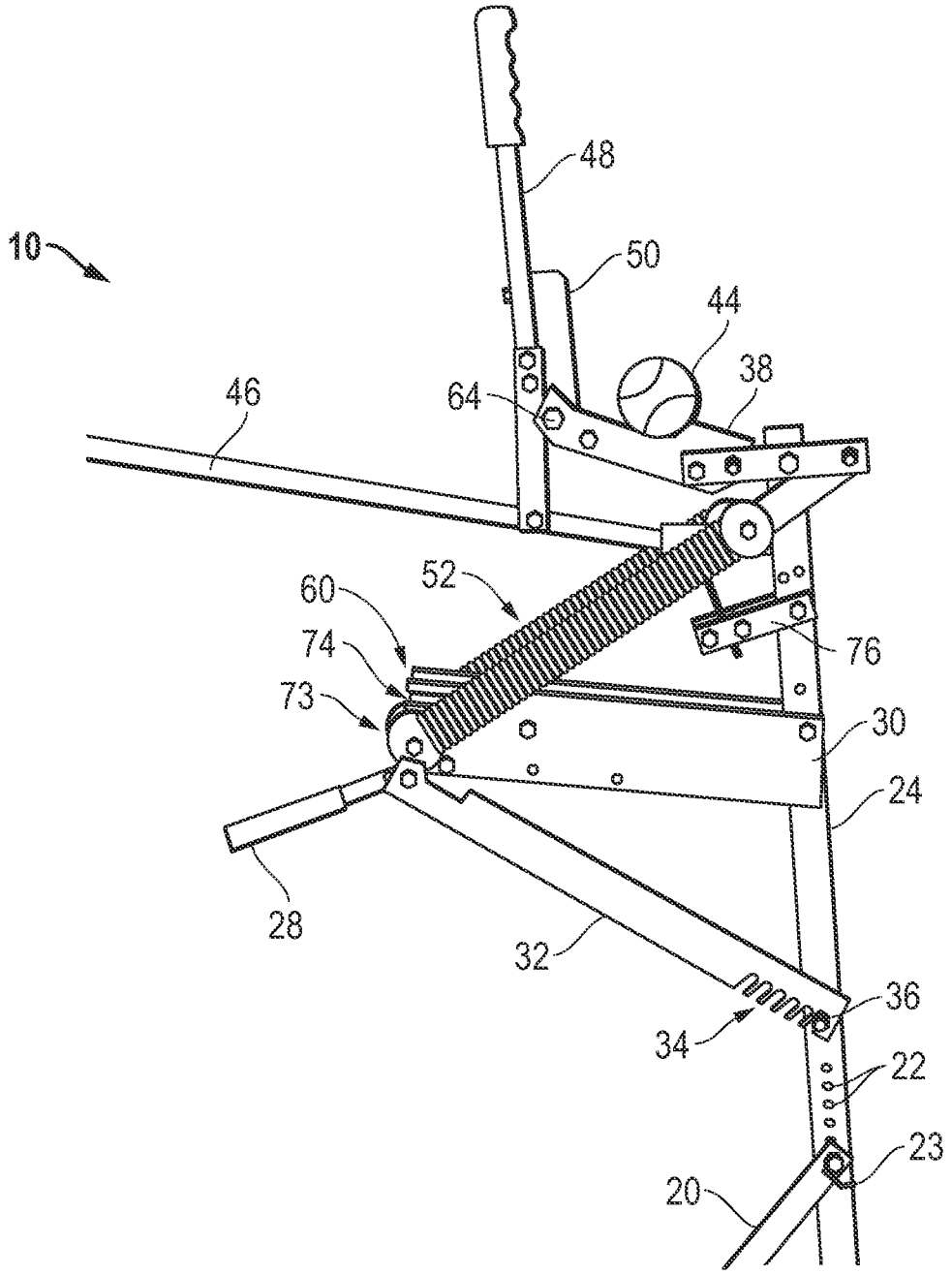
FIG. 8 is a side view of the invention of FIG. 1 in the cocked position configured to throw a fastball at slow speeds.
Figure 9:
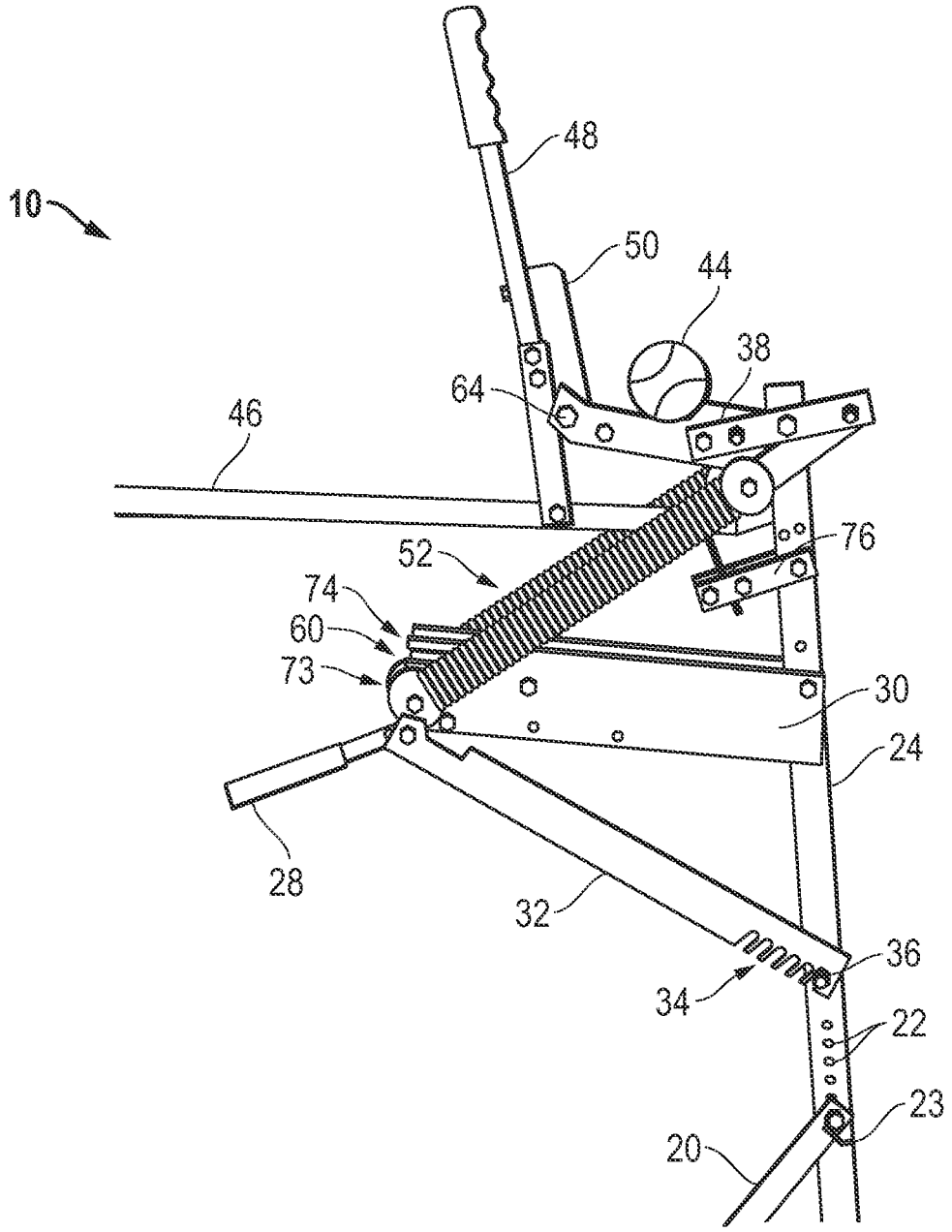
FIG. 9 is a side view of the invention of FIG. 1 in the cocked position configured to throw a fastball slowest speed.

FIG. 1 also shows micro-adjuster knob 62 (more clearly shown in FIG. 7). Micro-adjuster knob 62 is connected with the main body 24 by means of micro-adjuster bracket 76 and is configured to adjustably contact the cocking arm 46 when the cocking arm 46 is in the cocked position as shown in FIGS. 4, 8 and 9. By means of adjusting the micro-adjuster knob 62 the position at which the stop, cocked, position of the cocking arm 46 is reached is adjustable providing the user with a quick and easy device to implement small corrections to the path of a thrown projectile 44.

In one embodiment, power assembly 52 is a spring as shown and, preferably a pair of springs as illustrated. Other power assemblies that are now known or hereafter developed are included within the scope of the present invention.

Figure 2:
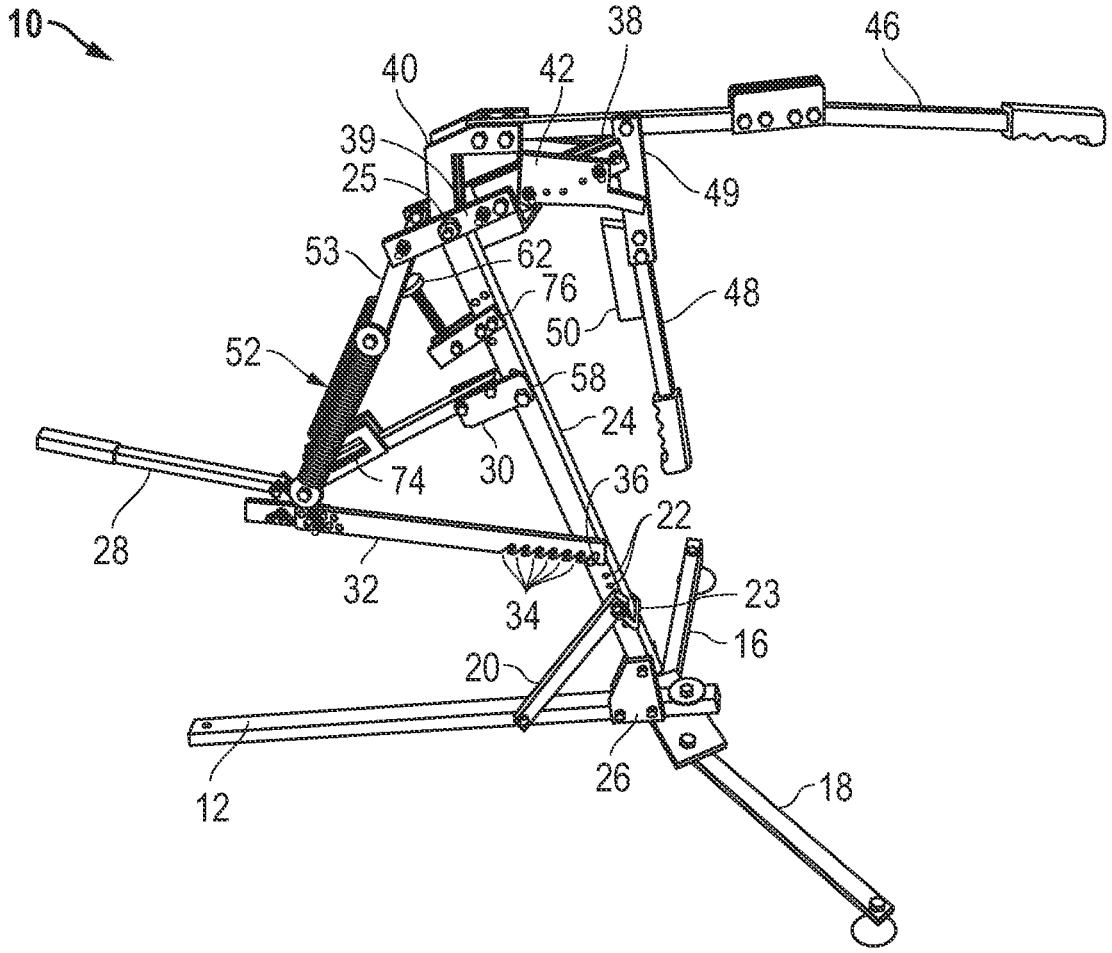
FIG. 2 is a perspective view of the invention of FIG. 1 with the cocking arm and release arm rotated such that the release arm connects with the throwing assembly.

All of the Figures use the same identifying numbers for the parts identified in FIG. 1. FIG. 2 illustrates with the cocking arm 46 and release arm 48 rotated over the top of the main body 24 in the direction of the front supports 14 such that the release arm 48, release arm block 50, connects with the throwing assembly 38 as with cross bar 64 for example only and not by limitation.

Figure 3:
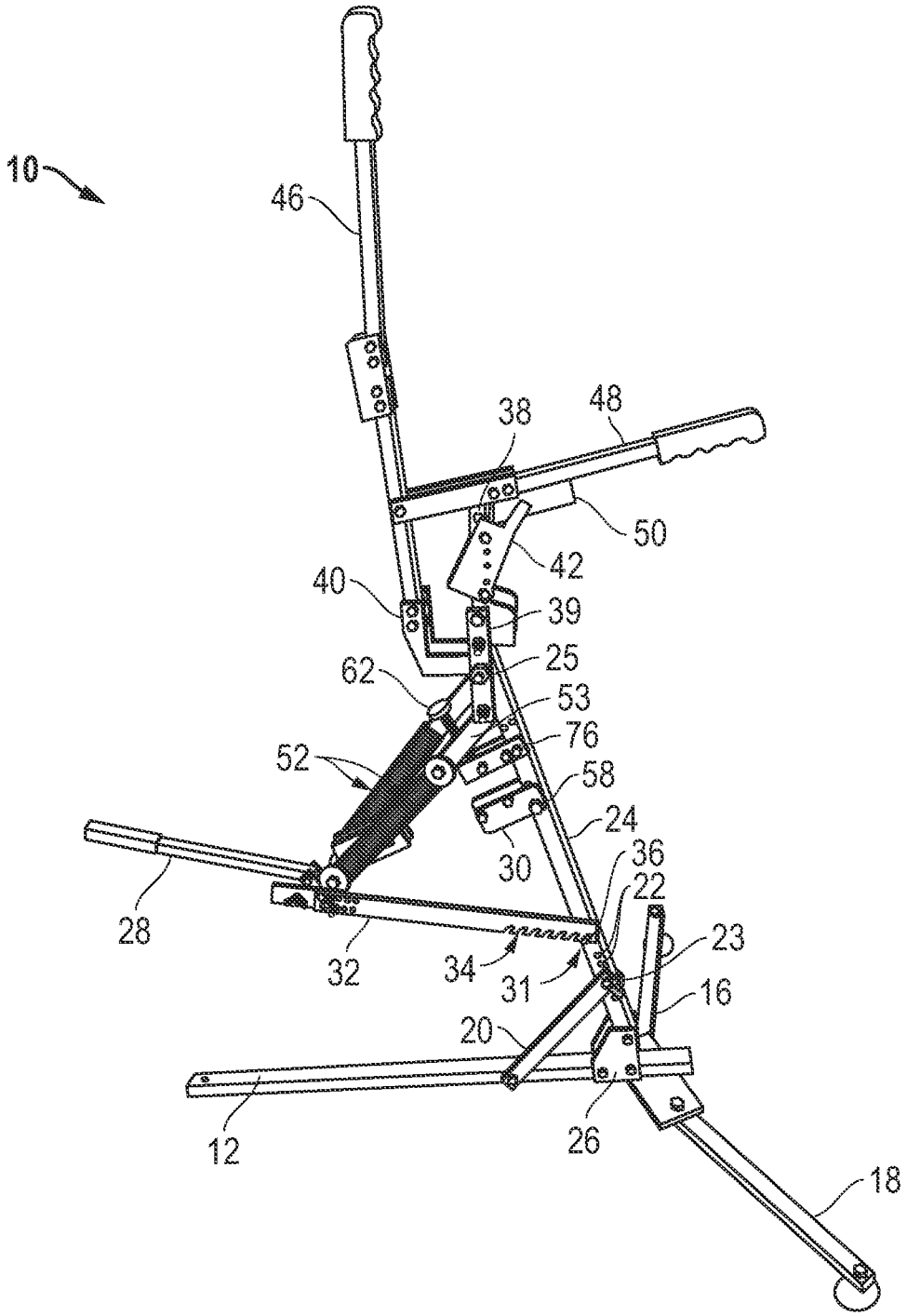
FIG. 3 is a perspective view of the invention of FIG. 1 with the release arm connected with the throwing assembly as the cocking arm is pulled back to a cocked position.

FIG. 3 shows the release arm 48 connected with the throwing assembly 38 as the cocking arm 46 is pulled back over the top of the main body 24 toward a cocked position.

FIG. 4 shows the invention in the cocked position with a projectile 44 in place on the throwing assembly 38. At this point, the user has two hands on the throwing apparatus 10, one on the cocking arm 46 holding it against the micro-adjuster knob 62 and one on the release arm 48. When ready, the user simply pulls back on release arm 48 such that release block 50 is pulled off of cross bar 64 and the power assembly 52 moves the bottom of the throwing assembly 38 down and back and rotating the top of the throwing assembly 38 upward and forward such that projectile 44 is launched from the throwing assembly 38 over the front support leg 14.

It should be understood that the throwing apparatus 10 may be configured to throw any kind of projectile 44 such as baseballs, softballs, soccer balls, tennis balls and volleyballs, for example only but not by limitation.

Figure 5:
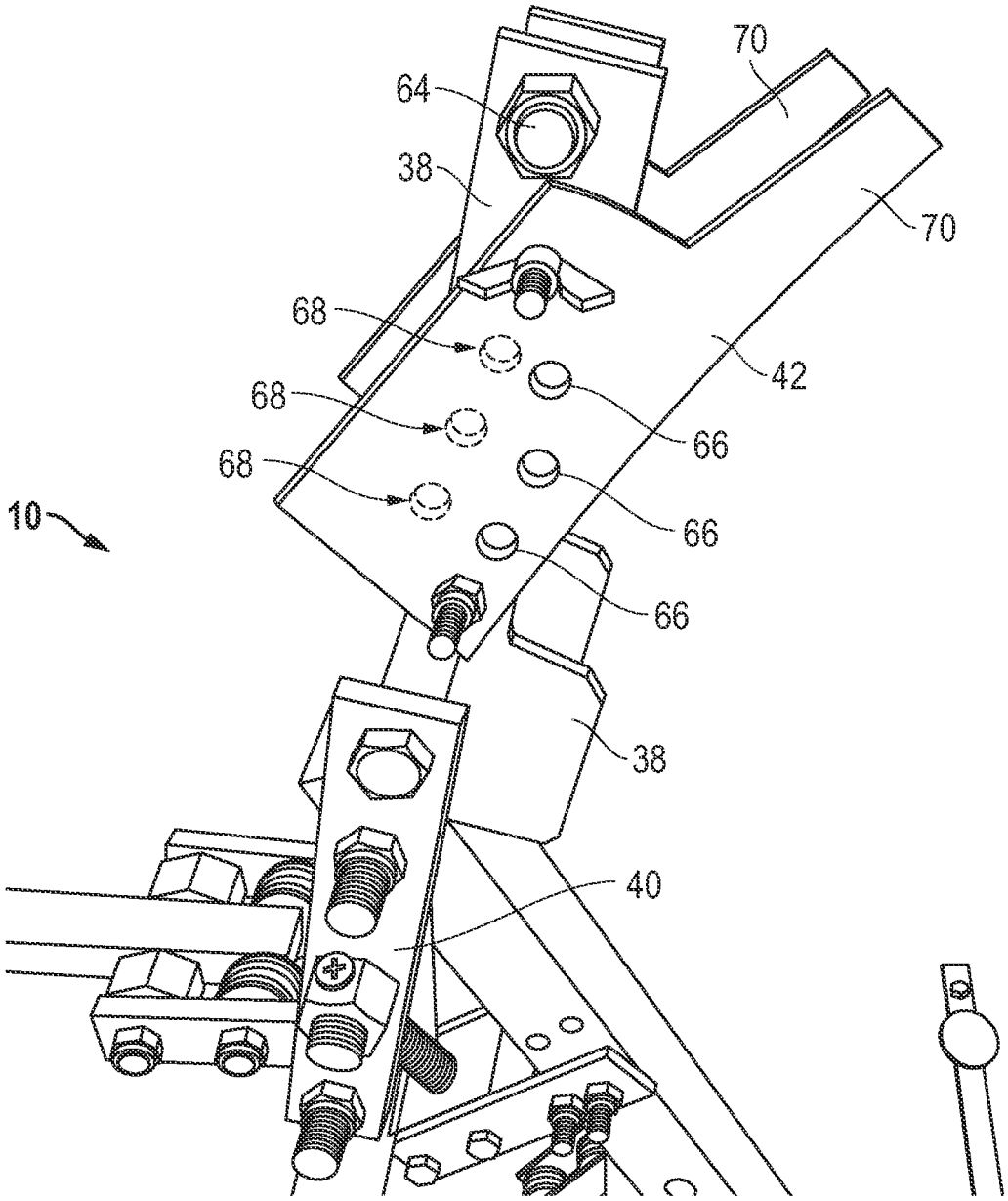
FIG. 5 is a close up view of the adjustable angle assembly connected with the throwing assembly of the invention of FIG. 1.

FIG. 5 is a close up view of the adjustable angle assembly 42 connected with the throwing assembly 38. Importantly, in one aspect, the adjustable angle assembly 42 includes a series of non-linear connection holes 66 and the throwing assembly 38 includes a series of linear connection holes 68 such that connection of one of the adjustable angle assembly 42 series of non-linear connection holes 66 with one of the throwing assembly 38 series of linear connection holes 68 creates a selected angle. Also, as shown, preferably, the adjustable angle assembly 42 includes a pair of side guides 70 such that the projectile 44 is supported by the throwing assembly 38 and by the pair of side guides 70.

Figure 13A:
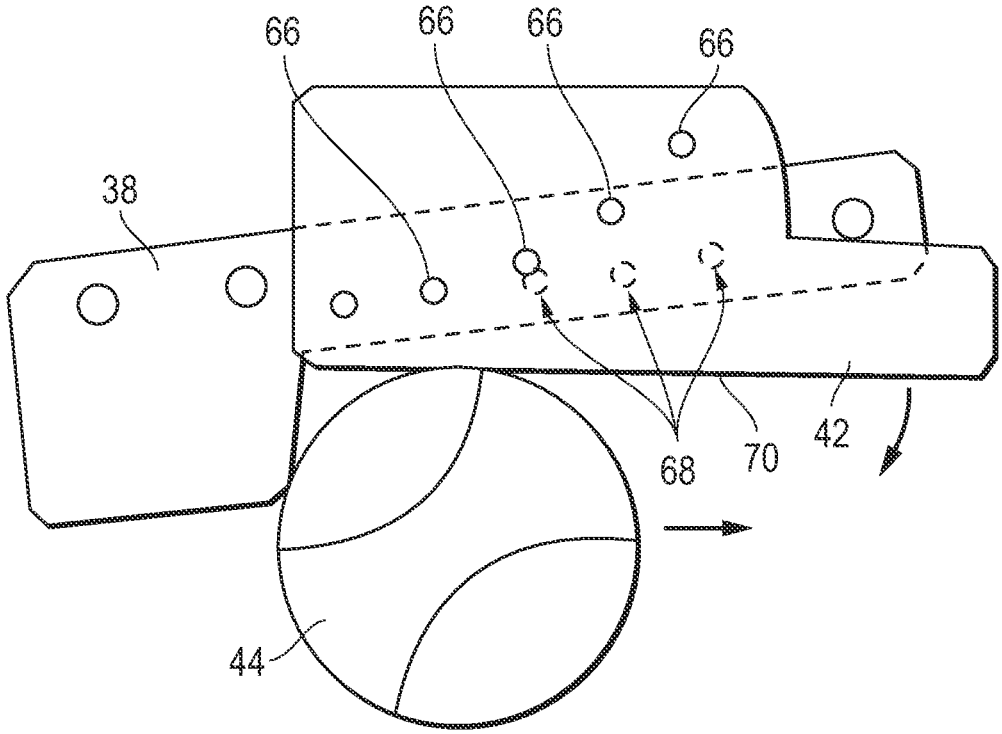
FIGS. 13 A and 13B are schematic side views of the throwing assembly and the adjustable angle assembly where FIG. 13 A shows the throwing assembly and adjustable angle assembly together with a projectile in place and where FIG. 13 B is an exploded two part view of the throwing assembly and adjustable angle assembly separated.
Figure 13B:
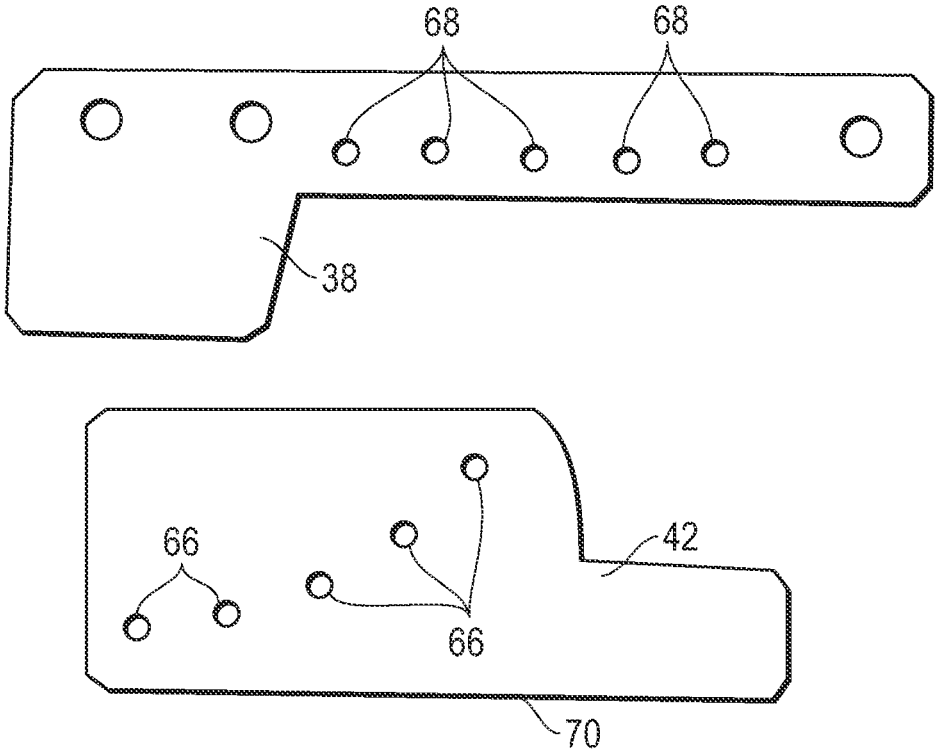

Further, FIG. 13 shows how the adjustable angle assembly 42 quickly and easily changes configuration for throwing fly balls and slow pitch soft balls by using nonlinear connection hole number 1; light flight balls in nonlinear connection hole number 2; baseballs in nonlinear connection hole number 3 and fast pitch softballs in nonlinear connection hole number 4 in combination with linear connection holes 68 on throwing assembly 38.

Figure 14:
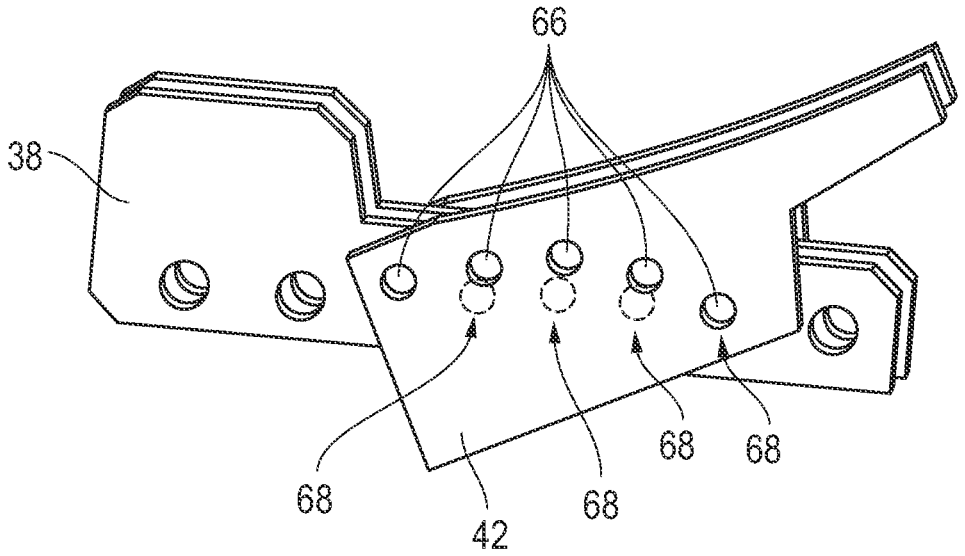
FIG. 14 is a schematic side view of the throwing assembly and the adjustable angle assembly where the side guides are curved, non-straight edges.

FIG. 14, as does FIG. 5, shows the preferred embodiment of the adjustable angle assembly 42 where the side guides 70 are arced and not straight. Applicant has determined by testing that the an arc of approximately sixteen but not exceeding twenty degrees provides the best results.

Figure 6:
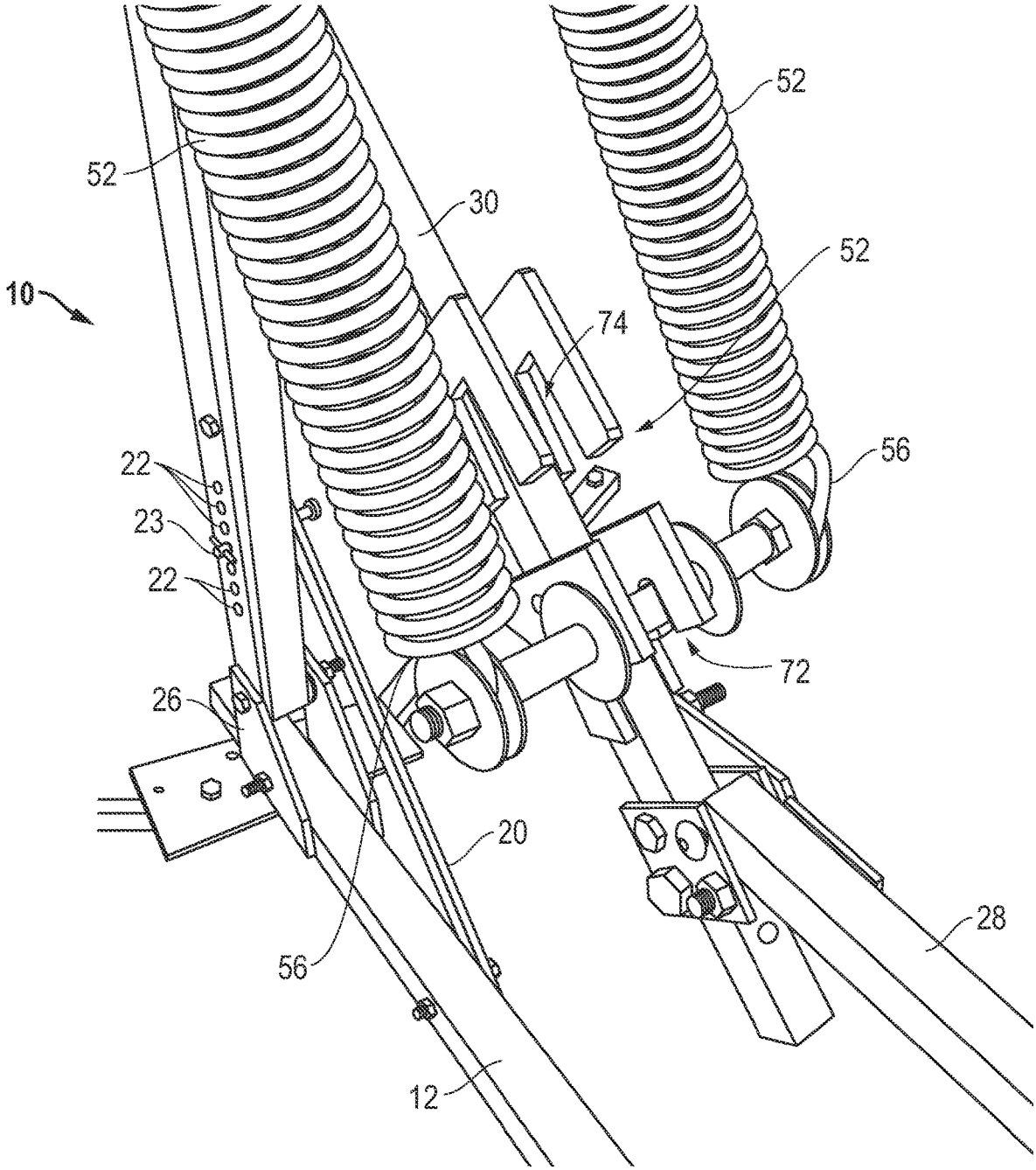
FIG. 6 is a close up of the velocity bracket the invention of FIG. 1.

FIG. 6 is a close up of the velocity bracket 30. Preferably, the velocity bracket 30 includes a first power assembly notch 72 configured to hold the second end 56 of the power assembly 52 against movement meaning it fits in and once in is restricted from moving in the notch. That is, as shown, it is meant that once the second end 56 of the power assembly 52 is fitted into first power assembly notch 72 the second end 56 cannot move during operation, its position is fixed since the notch just matches the dimensions of the second end 56 as shown. This position is best, Applicant has found, when the need is to throw a projectile 44 at above slow speeds.

Additionally, preferably, the velocity bracket 30 also includes a second power assembly notch 74 where the second power assembly notch 74 is longer than the first power assembly notch 72 as shown. As a result, the second end 56 of the power assembly 52 is free to move along the longer second power assembly notch 74. This prevents the power assembly 52 from bunching up or binding when lower speeds are desired. This position is best, Applicant has found, therefor when the need is to through a projectile 44 at slow speeds such for slow pitch softball or when throwing to young children or inexperienced participants.

FIG. 7 is a close up of the micro-adjuster knob 62 attached to micro-adjuster bracket 76 that is connected with main body 24. Simply adjusting the micro-adjuster knob 62 up or down establishes a new contact point, and thus, stopping the cocking arm 46 and establishing the "cocked position" for the cocking arm 46 and adjusts the resulting delivered height of the thrown projectile 44.

FIG. 8 illustrates the configuration of the apparatus in the cocked position and ready to throw projectile 44 in faster than slow speeds. Here the second end 56 of power assembly 52 is located in the first, non-moving/movement prevention, power assembly notch 72. At the same time, speed control bracket 32 is positioned such that the very first of the speed control slots 34 is connected to bolt 36 and main body 24. Applicant has determined that in this configuration throwing apparatus 10 will throw the projectile 44 at approximately thirty miles per hour (MPH). Further, Applicant has determined by testing that speeds increase about two miles per hour on each subsequent speed control slot 34. As slots are used that are farther and farther away from the first slot, the speed control bracket 32 is effectively shortened which in turn effectively stretches power assembly 52 and increase the speed of the thrown projectile 44.

FIG. 9 illustrates the configuration of the apparatus in the cocked position and ready to throw projectile 44 at the slowest speeds. Here the second end 56 of power assembly 52 is located in the second power assembly notch 74. The elongated form of the second power assembly notch 74, again, allows the second end 56 of the power assembly 52 to slide back and forth and prevents binding of the power assembly 52 when the tension on it is slight. As with FIG. 8, speed control bracket 32 is positioned such that the very first of the speed control slots 34 is connected to bolt 36 and main body 24. This produces the very slowest speeds as may be required.

By way of continued description, the present invention is mechanically operated so no electricity is needed for power. This device is foldable which allows for easy transport (See FIG. 12). This device is designed with a power system structure that stays within the recommended tension rate of the springs used which means there will not often be a weak spring that needs to be replaced as with prior art devices.

This device requires two hands to operate the machine verses a prior art foot pedal. This machine can be operated easily with either arm being the dominant arm. The device with the throwing assembly and angle adjustment assembly, does not require any parts to be removed and replaced to change ball type being launched. This device has built in anchor points that allow the user to secure the device to the ground without the use of sandbags. This device is equipped with a velocity bracket that allows a user to slide the power assembly into different speed control slots, which in turn allows a user to change ball types and speeds of balls without removing any parts. It is designed so the power assembly does not bind during cocking when throwing slower pitches. This is accomplished by allowing the bottom, second end 56, of the power assembly to slide to the position needed for the speed desired, which is determined by the chosen notch on the velocity bracket. At faster speeds, the position is set, but at slower speeds, this sliding adjustment allows the machine to throw different size, weight, or types of balls at slower speeds for younger players.

To solve the problem of excessive wear at the points of stress, this machine uses adjustable triangular bracing, base angle bracket 20, with one end attached to the base and the other easily and quickly pinned to the main body at the angle desired.

As shown in the figures, front support leg 14 connects to the base 12. The base 12 is connected to the main body 24 with the hinge angle bracket 26 as well as the base angle bracket 20. The velocity bracket 30 is connected to main body 24 and the speed control arm 28 is secured to the velocity bracket 30. Preferably, a speed control arm handle 29 is connected to the speed control arm 28 as shown. In operation, speed control arm 28 is connected to the main body 24 by location of the speed control bracket 32 in the desired speed control slot 34.

The micro-adjuster knob 62 is connected to a micro-adjuster bracket 76 that is connected to the main body 24. A main body axle 25 is connected with the main body 24. A throwing assembly bracket 39 is connected to the main body axle 25 in its approximate middle with the throwing assembly 38 connected on one end of the throwing assembly bracket 39. The power assembly 52 is connected to a power assembly bracket 53 at the other end of the throwing assembly bracket 39 with the main body axle 25 in between. The first end 54 of the power assembly 52 is connected to the power assembly bracket 53.

Cocking arm bracket 40 is connected to the main body axle 25 at one end and is connected with the cocking arm 46 at the other. The cocking arm 46 is connected to a release arm connecting bracket 49. The release arm connecting bracket 49 connects to the release arm 48 and the release arm 48 is connected to the release arm block 50.

In operation, the cocking arm 46 and release arm 48 are pushed over the top of the main body 24 toward the front of the throwing apparatus 10, i.e. in the direction toward the front support legs 14. (See FIGS. 1 and 2). At that point, the release block 50 catches onto the front cross bar 64 of the throwing assembly 38 (See FIGS. 2, 3 and 4) and the user pulls back on the cocking arm 46 which rotates the throwing assembly bracket 39 on the main body axle 25 and pulls the throwing assembly 38 over the top of the throwing apparatus 10 (See FIGS. 3 and 4), while simultaneously tensioning the power assembly 52 and placing the machine in a "cocked position" when it is stopped by the micro adjuster knob 62 (See FIG. 4). A projectile 44 is placed in the throwing assembly 38 and, when the release arm 48 is pulled back, the release arm 48 causes the release block 50 pull off of and lose contact with front cross bar 64. At that point, the power assembly 52 causes the throwing assembly 38 to rotate on the main body axle 25 and release projectile 44 toward a target in front of the throwing apparatus 10.

The trajectory of the projectile 44, as should be clear by now, is adjustable in many different ways according to the present invention. In one way, the trajectory is adjusted by manipulating the micro-adjuster knob 62. In operation, the top of the micro-adjuster knob 62 acts to stop the movement of the cocking arm 46 by contact with the bottom of the cocking arm 46 (See FIG. 1). The height of micro-adjuster knob 62 thereby controls where the cocking arm 46 stops rotating and defines the "cocked position" and the position of the cocking arm 46 dictates the starting launch position of the throwing assembly 38.

Figure 10:
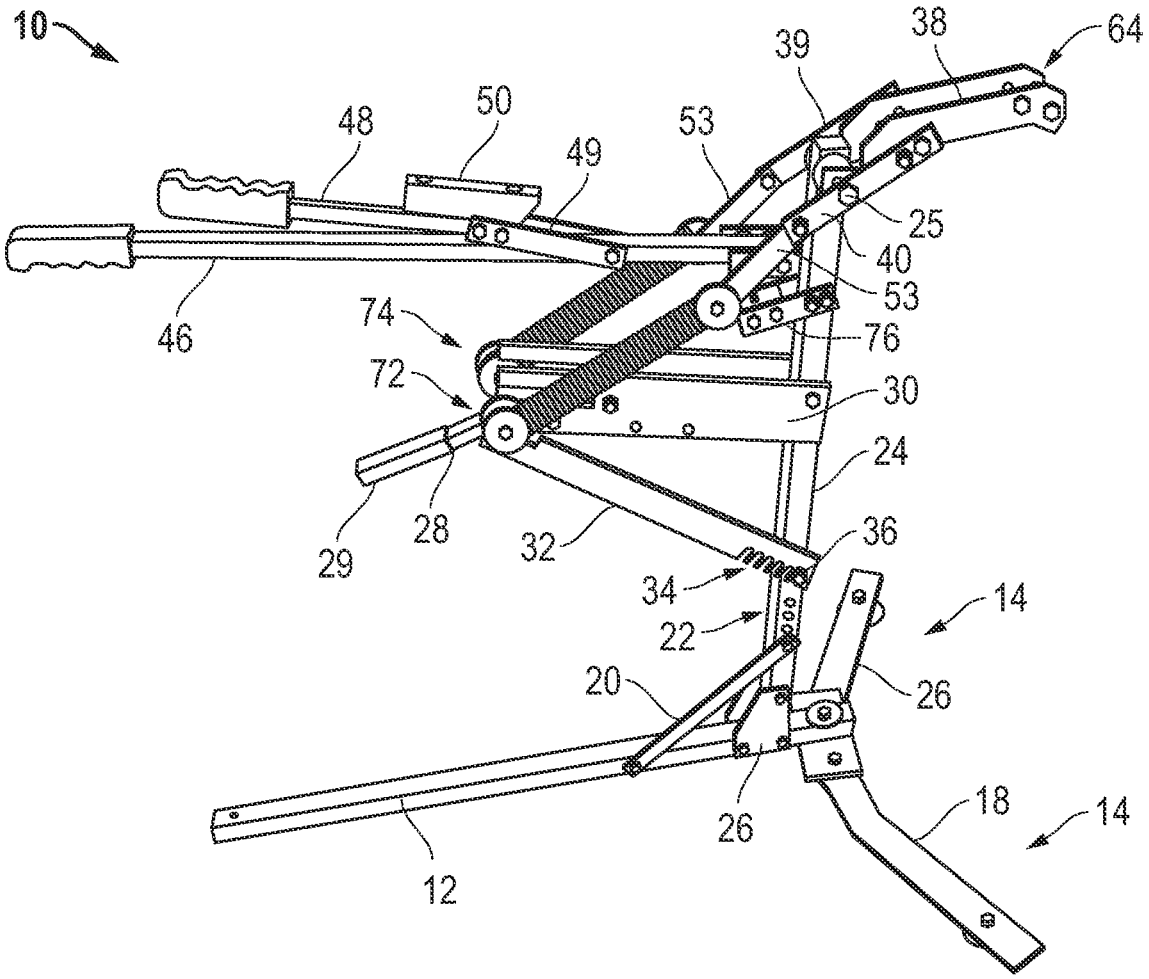
FIG. 10 is a perspective view of the invention of FIG. 1 with the main body and base angle bracket to support the main body perpendicular to the base.
Figure 11:
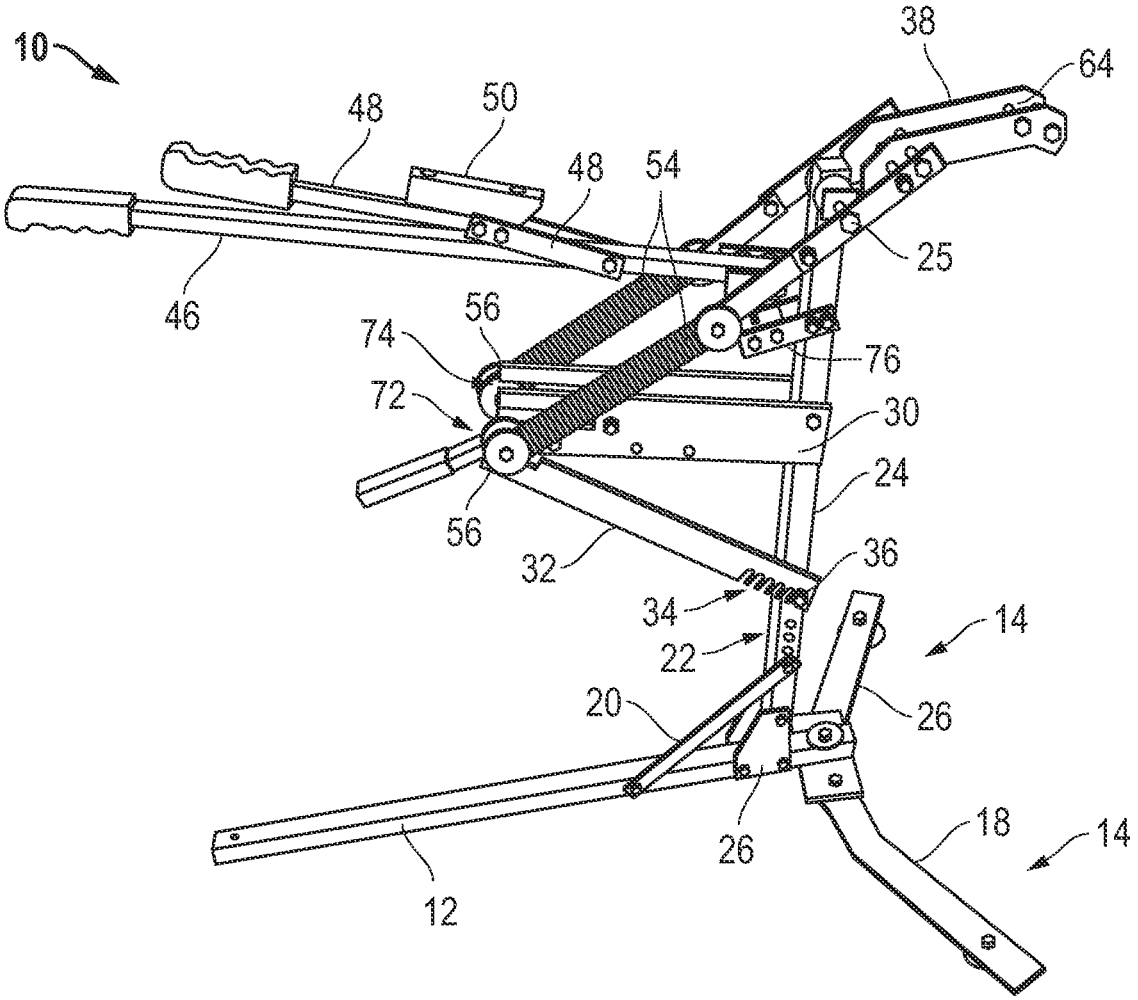
FIG. 11 is a perspective view of the invention of FIG. 1 with the main body and base angle bracket to support the main body angled toward the front support legs.

Likewise, as described herein, the trajectory of a projectile is adjustable in at least three additional ways by means of adjusting the adjustable angle assembly 42 (See FIGS. 5, 13 and 14), the choice of speed control slots 34 (See FIG. 6) and the selection of location holes 22 (See FIGS. 1, 10 and 11). FIGS. 13 A and 13 B show the two part adjustable angle assembly 42 used with throwing assembly 38 for adjusting the trajectory of projectile 44.

The speed of the thrown projectile 44 is adjustable by use of the speed control arm 28. In order to adjust the speed, a user loosens a speed control arm retainer 31, such as a wing nut connected to the bolt 36 at the main body 24, for example only. Pushing speed control arm handle 29 downwards releases speed control bracket 32 speed control slot 34 from the bolt 36 at the main body 24. The user then selects the desired speed control slot 34 in the speed control bracket 32 and hooks the desired speed control slot 34 over the bolt 36 and tightens the speed control arm retainer 31.

Still further, as shown in FIGS. 10 and 11, the user is also enabled by the present invention to adjust the machine for various types of speeds and projectiles by adjusting the starting angle of the main body 24. To do so, a location retaining pin 23 is removed from its location 22 on the main body 24 breaking the connection with the top of the base angle bracket 20. This allows the main body 24 to move on hinge bracket 26 and to be pushed forward (See FIG. 11) or pulled backwards (See FIG. 1) or fixed perpendicular to the base 12 (See FIG. 10) and then to align the base angle bracket 20 with the desired positioning location 22 on the main body 24. Once aligned, location retaining pin 23 is inserted through the base angle bracket 20 and through main body and secured in place.

Figure 12:
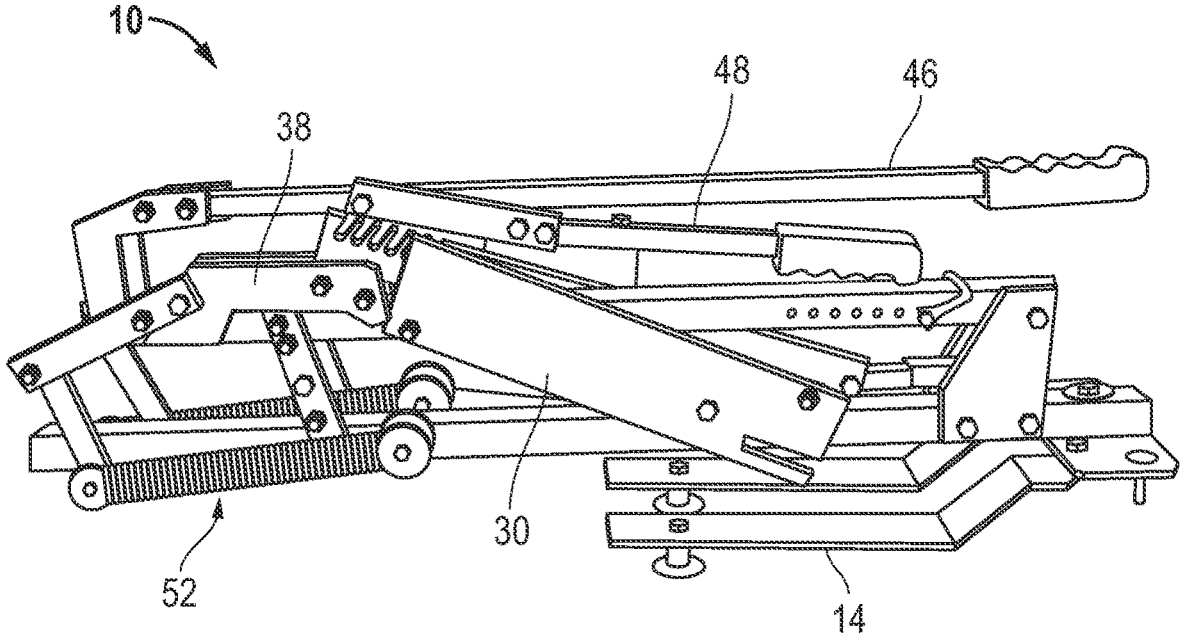
FIG. 12 is a side view of the invention of FIG. 1 in a folded position.

Folding Function:

Applicant's apparatus 10 is completely foldable and when folded is compact in form and thus much more economical to ship and transport as shown in FIG. 12. In order to fold the apparatus, a user loosens the speed control arm retainer 31 and lifts the speed control arm 28 off of bolt 36. Then the user removes the power assembly 52 second end 56 from the velocity bracket 30 speed control slot 34 from the bolt 36 and folds the speed control arm 28 towards the top of the machine away from the base 12. Location retaining pin 23 is removed from the location pin hole 22. Base angle bracket 20 is folded down toward the rear of the machine until it is level with the base 12. The top of the main body 24 can now be folded towards the back of the base 12 until it sits flush with the top of the base 12. Finally, the user folds the cocking arm 46 and the release arm 48 over the top of the throwing assembly 38. Once folded, the entire apparatus measures six inches by ten inches by thirty-four inches, something no other prior art throwing apparatus can match.

The description of the present embodiments of the invention has been for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A throwing apparatus comprising:

a. a main body connected to a base;

b. a cocking arm connected with the main body at a main body axle and movably connected with a release arm;

c. a throwing assembly connected to a throwing assembly bracket connected to the main body at said main body axle, the throwing assembly configured to support a projectile, wherein the release arm is configured to releasably connect with the throwing assembly; and d. a power assembly with a first end and a second end, where the first end is connected with said throwing assembly bracket, said power assembly configured to releasably connect with a velocity bracket wherein said velocity bracket is movably connected with said main body and includes more than one power assembly notch configured to receive said second end of said power assembly wherein the velocity bracket includes a first power assembly notch configured to hold the second end of the power assembly against movement and a second power assembly notch wherein the second power assembly notch is longer than the first power assembly notch such that the second end of the power assembly is free to move along the longer second power assembly notch.

2. The apparatus of claim 1 wherein the throwing assembly includes an adjustable angle assembly movably connectable with the throwing assembly, wherein said projectile is held at selected angles in relation to the throwing assembly by said adjustable angle assembly.

3. The apparatus of claim 2 wherein the adjustable angle assembly includes a pair of side guides such that said projectile is supported by the throwing assembly and by said pair of side guides and wherein the side guides are curved, non-straight edges.

4. The apparatus of claim 2 wherein the adjustable angle assembly includes a series of non-linear connection holes and said throwing assembly includes a series of linear connection holes such that connection of one of said adjustable angle assembly series of non-linear connection holes with one of said throwing assembly series of linear connection holes creates a selected angle.

5. The apparatus of claim 1 further including a micro-adjuster knob connected with said main body configured to adjustably contact the cocking arm in a cocked position.

6. The apparatus of claim 1 further including a speed control arm connected with said second end of said power assembly said speed control arm including a speed control bracket with more than one speed control slot wherein said more than one speed control slot is selectively connectable with said main body.

7. The apparatus of claim 1 further including a base angle bracket connected with said base and adjustably connectable with said main body at more than one location along said main body and wherein said main body is connected with said base with a hinge bracket such that an angle of the main body in relation to the base is adjustable at said more than one location with said base angle bracket.

8. A throwing apparatus comprising:

a. a main body connected to a base;

b. a cocking arm connected with the main body at a main body axle and movably connected with a release arm;

c. a throwing assembly connected to a throwing assembly bracket connected to the main body at said main body axle, wherein the throwing assembly includes an adjustable angle assembly movably connectable with the throwing assembly, the throwing assembly configured to support a projectile, wherein said projectile is held at selected angles in relation to the throwing assembly by said adjustable angle assembly and wherein the release arm is configured to releasably connect with the throwing assembly d. a power assembly with a first end and a second end, where the first end is connected with said throwing assembly bracket, said power assembly configured to releasably connect with a velocity bracket wherein said velocity bracket is movably connected with said main body and includes more than one power assembly notch configured to receive said second end of said power assembly;

e. a speed control arm connected with said velocity bracket said speed control arm including a speed control bracket with more than one speed control slot wherein said more than one speed control slot is selectively connectable with said main body; and f. a base angle bracket connected with said base and adjustably connectable with said main body at more than one location along said main body and wherein said main body is connected with said base with a hinge bracket such that the angle of the main body in relation to the base is adjustable.

9. The apparatus of claim 8 further including a micro-adjuster knob connected with said main body configured to adjustably contact the cocking arm in a cocked position.

10. He apparatus of claim 8 wherein the power assembly is a spring.

11. The apparatus of claim 10 wherein the power assembly is a pair of springs.

12. The apparatus of claim 8 wherein the adjustable angle assembly includes a series of non-linear connection holes and said throwing assembly includes a series of linear connection holes such that connection of one of said adjustable angle assembly series of non-linear connection holes with one of said throwing assembly series of linear connection holes creates a selected angle.

13. The apparatus of claim 8 wherein said projectile is selected from a group consisting of: baseballs, softballs, soccer balls, tennis balls and volleyballs.

14. The apparatus of claim 8 further including a front support leg connected to said base extending to both sides of the base.

15. The apparatus of claim 14 wherein the front support leg includes a first leg and a second leg wherein the first leg and the second leg are pivotally connected to said base.

16. The apparatus of claim 8 wherein the adjustable angle assembly includes a pair of side guides such that said projectile is supported by the throwing assembly and by said pair of side guides and wherein the side guides are curved, non-straight edges.

17. A projectile throwing method consisting of:

a. providing a main body connected to a base:

a cocking arm connected with the main body at a main body axle and movably connected with a release arm;

a throwing assembly connected to a throwing assembly bracket connected to the main body at said main body axle, wherein the throwing assembly includes an adjustable angle assembly movably connectable with the throwing assembly the throwing assembly configured to support a projectile, wherein said projectile is held at selected angles in relation to the throwing assembly by said adjustable angle assembly and wherein the release arm is configured to releasably connect with the throwing assembly;

a power assembly with a first end and a second end, where the first end is connected with said throwing assembly bracket, said power assembly configured to releasably connect with a velocity bracket wherein said velocity bracket is movably connected with said main body and includes more than one power assembly notch configured to receive said second end of said power assembly;

a speed control arm connected with said velocity bracket said speed control arm including a speed control bracket with more than one speed control slot wherein said more than one speed control slot is selectively connectable with said main body;

and a base angle bracket connected with said base and adjustably connectable with said main body at more than one location along said main body and wherein said main body is connected with said base with a hinge bracket such that an angle of the main body in relation to the base is adjustable; and b. moving the cocking arm to connect the release arm with the throwing assembly and moving the cocking arm to a cocked position.

18. The method of claim 17 further including a micro-adjuster knob connected with said main body configured to adjustably contact the cocking arm in said cocked position.

19. The method of claim 17 wherein the power assembly is a spring.

20. The method of claim 17 wherein said projectile is selected from a group consisting of: baseballs, softballs, soccer balls, tennis balls and volleyballs.

* * * * *